United States Patent [19]

Yoshiyuki et al.

[11] Patent Number: 4,505,100

[45] Date of Patent: Mar. 19, 1985

[54] HEAT-DURABLE SPUN-LIKE FASCIATED YARN AND METHOD FOR PRODUCING THE SAME

[75] Inventors: Sasaki Yoshiyuki, Takatsuki; Matsumoto Mitsuo, Ibaragi, both of Japan

[73] Assignee: Teijin Limited, Osaka, Japan

[21] Appl. No.: 487,199

[22] Filed: Apr. 21, 1983

[51] Int. Cl.[3] ..... D02G 3/02; D02G 3/34; D02G 3/22

[52] U.S. Cl. ..... 57/207; 57/210; 57/243; 57/328; 57/350

[58] Field of Search ..... 57/3, 5, 6, 200, 207, 57/210, 224, 252, 255, 256, 285, 287, 310, 315, 328, 330, 331, 350

[56] References Cited

U.S. PATENT DOCUMENTS

| | | | |
|---|---|---|---|
| 3,079,746 | 3/1963 | Field | 57/328 |
| 3,365,872 | 1/1968 | Field | 57/328 X |
| 4,003,194 | 1/1977 | Yamagata et al. | 57/328 |
| 4,114,358 | 9/1978 | Tsuchida et al. | 57/350 X |
| 4,265,082 | 5/1981 | Sasaki et al. | 57/207 |
| 4,350,731 | 9/1982 | Siracusano | 57/210 X |
| 4,356,690 | 11/1982 | Minorikawa et al. | 57/252 X |
| 4,384,448 | 5/1983 | Wilkie | 57/328 X |

*Primary Examiner*—Donald Watkins

*Attorney, Agent, or Firm*—Burgess, Ryan & Wayne

[57] ABSTRACT

A fasciated yarn, consisting of wholly aromatic polyamide fibers, which is excellent in mechanical properties, especially in creep durability in a high temperature atmosphere and is suitably utilized for industrial usage. The yarn can be produced by a method comprising the steps of: stretch-breaking a filament tow of the wholly polyamide fibers to form a staple fiber bundle and imparting a false-twist to the staple fiber bundle by a vortex while retaining parallelism of the staple fibers composing the bundle, thereby obtaining the fasciated yarn. Structural characteristics of the yarn reside in a mean fiber length in the range of from 150 mm to 600 mm, a crimpability of less than 5%, a mean degree of parallelism of less than 3°, and a number of wrap fiber groups in a range of from 0.5 to 20 per 1 cm in length of the yarn.

2 Claims, 6 Drawing Figures

HEAT-DURABLE SPUN-LIKE FASCIATED YARN AND METHOD FOR PRODUCING THE SAME

BACKGROUND OF THE INVENTION

1. Field of the Invention

The present invention relates to a spun-like fasciated yarn having good heat durability maintaining excellent mechanical strength and less creep deformation even under a high temperature condition exceeding 300° C.

2. Description of the Prior Art

It is well-known that wholly aromatic polyamide fibers such as poly-para-phenyleneterephthalamide or poly-meta-phenyleneisophthalamide which is on the market under the trade name "Kevlar®" from Du Pont de Nemours and Co. of USA or "Cornex®" from Teijin Limited of Japan, has superior mechanical strength and high modulus as well as good heat durability and anti-erosive properties. Due to the above-mentioned advantages, they are widely utilized in the industrial field.

These fibers are used not only in filament form but also preferably in the form of spun yarn. For example, a bag filter is one of the suitable usages of the wholly aromatic polyamide fibers because the bag filter has to often be exposed to a high temperature and erosive atmosphere. In this case, a fabric woven from the spun yarn of such a fiber is expected to be more advantageous than a filament yarn fabric because of a better filtration ability caused by a relatively looser structure and a larger thickness of the spun yarn than of the filament yarn. However, according to a conventional spinning process, a resultant spun yarn cannot satisfactorily be applied to the aforesaid object due to the reasons explained below.

Since polymers of the above-mentioned heat durable fibers do not show a clear melting point but have a wide range decomposition point close to the former, it is very difficult to adopt a melt spinning system to prepare a fiber. Accordingly, the fiber can be formed only by the dry spinning or wet spinning of a solution in which the polymer is dissolved by a suitable solvent. Under such conditions, it is more advantageous to have a thicker tow for staple fibers than to have a plurality of thinner filament yarns. Since the tow for staple fibers has a very large thickness of, for example, from several dozen thousand denier to several hundred thousand denier, a higher draw ratio is hardly attainable. This insufficient drawing as well as a residual solvent in the fiber unremoved during the spinning process result in an undesirable lower tensile strength and a lower Young's modulus of the resultant fiber than expected from a structure of a recurring unit of the polymer.

Further, to have a spun yarn, the tows thus obtained are cut into staple fibers after being crimped and, thereafter, are subjected to a conventional complicated spinning process comprising scutching, carding, drawing, doubling, twisting, etc. As a result, the fibers in the spun yarn are considerably disoriented and deformed. This causes, along with the crimps thereof, a greater elongation and lower strength of the yarn. Especially, since the wholly aromatic polyamide fiber lacks a spinnability due to its hardness and rigidity, the abovesaid tendency is accelerated. Accordingly, the spun yarn has an undesirable creep deformation, especially in a high temperature atmosphere, compared to a filament yarn. This is the reason why the conventional spun yarn of the wholly aromatic polyamide fibers is unsatisfactory in the above-mentioned object.

SUMMARY OF THE INVENTION

The present inventors have studied a long time to obtain a spun yarn having none of the drawbacks mentioned above, and succeeded in accomplishing the present invention which provides an excellent spun yarn having a higher mechanical strength and a desirable anti-creep property under a high temperature condition relative to those of a filament yarn. Before, it was believed that filament yarn was superior to spun yarn regarding the above-mentioned items due to the continuity thereof. However, the yarn according to the present invention contradicts this belief.

It is an object of the present invention to provide a spun yarn having a good heat durability as well as a higher mechanical strength and anti-creep property.

It is another object of the present invention to provide a novel method for producing the same.

The object of the present invention is attainable by a fasciated yarn consisting of staple fibers of a wholly aromatic polyamide polymer prepared by the stretch-breaking of a tow; comprising a core portion and a plurality of wrap fiber groups wrapped around the core portion, the yarn being characterized in that the staple fiber has a mean fiber length within a range of from 150 mm to 600 mm, a crimpability of less than 5%, and a mean degree of parallelism ($\overline{\theta}$) of less than 3°, and that the number of the wrap fiber groups is within the range of from 0.5 to 20 per 1 cm in length of said yarn, and a method for producing a fasciated yarn consisting of staple fibers of a wholly aromatic polyamide polymer comprising the following steps of: stretch-breaking a tow of filaments into a bundle of staple fibers taking care not to disturb the parallelism thereof, each filament of said tow having a crimpability of less than 5%; and subjecting said bundle of staple fibers, omitting the crimping process, to a fasciate spinning operation to form said fasciated yarn.

BRIEF DESCRIPTION OF THE DRAWINGS

The present invention is now more fully described referring to the accompanying drawings, in which.

DESCRIPTION OF THE PREFERRED EMBODIMENTS

Figure 1:
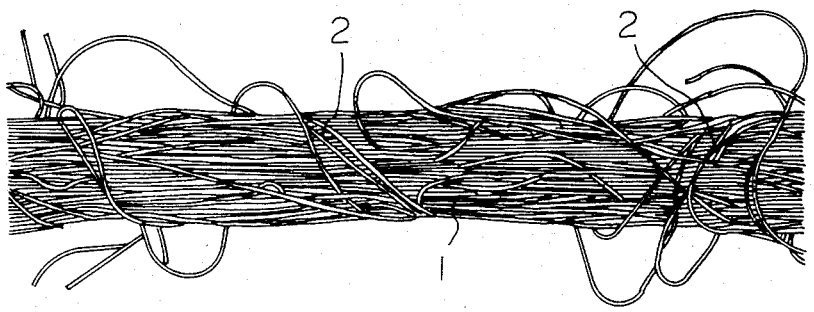
FIG. 1 shows an enlarged side view of a fasciated yarn according to the present invention.

A yarn according to the present invention is a fasciated yarn of the same type as those disclosed in U.S. Pat. No. 3,079,746 by F. C. Field, Jr. and U.S. Pat. No. 4,265,082 by Y. Sasaki et al. That is, the yarn comprises a core portion 1 having substantially no twist consisting of staple fibers and a plurality of wrap fiber groups 2 wrapped around the core portion.

The staple fibers composing the core portion 1 have to be substantially, parallel to an axis of the yarn. Distortion of the core portion fibers is represented as a mean degree of parallelism $\overline{\theta}$ and has to be less than 3° thereof according to the invention. That is, the mean degree of parallelism $\overline{\theta}$ is an inclination of the staple fiber bundle composing the core portion relative to the axis of the yarn, a measurement being carried out according to the following steps:

(1) preparing a length of 130 cm from the yarn to be measured as a test piece and marking thereon 12 marks at a distance of 10 cm;

(2) selecting 10 measuring points on the marks by omitting the two disposed at opposite sides, and, at the points, measuring an inclination angle $\theta°$ of the core portion bundle relative to the central axis of the yarn under a field of vision of a microscope; and (3) repeating the measurement regarding 10 test pieces and calculating a $\overline{\theta}$ as a mean value of the obtained data by the following equation (1), $$\bar{\theta}(°) = \frac{\Sigma\theta}{100} \quad (1)$$

The $\overline{\theta}$ exceeding 3° is not desirable, because the yarn shows an excess elongation corresponding to stress.

Further, the staple fiber composing the core portion has preferably no crimps, if any, a crimpability thereof being at most 5%. In this connection, the crimpability means a value measured according to JIS 1074-65, in which a single fiber of a length of 30 cm to be tested is loaded by a weight of 50 mg/d for 30 seconds and, thereafter, its length $l_0$ is measured, and the weight is replaced to a lighter one of 2 mg/d and, two minutes later, the length $l_1$ of the fiber is measured, the crimpability CR being calculated by the following equation (2), $$CR\ (\%) = \frac{l_0 - l_1}{l_0} \times 100 \quad (2)$$

The average value for 10 test pieces is representative of CR.

It is not preferable that the staple fibers in the core portion have the CR exceeding 5%, because, in such a case, the yarn becomes bulky causing a lower tensile strength and a greater elongation, especially under a high temperature condition.

A mean fiber length $\overline{L}$ of the staple fiber is necessarily within the range of from 150 mm to 600 mm. If the fiber length $\overline{L}$ is less than 150 mm, the tensile strength does not reach 3 g/d and, while, if the fiber length $\overline{L}$ is more than 600 mm, the yarn structure is similar to that of a filament yarn which lacks the bulkiness common in spun yarn. Both of them are not suitable for the object of the present invention.

The staple fiber composing the wrap fiber group 2 originates from the same source as the core portion fiber. One end of the wrap fiber is embedded in the core portion 1, and the other end thereof is free, which wraps around the core portion 1 and binds it to retain a yarn structure. The wrap fiber group fibers should have substantially the identical characteristics of the core portion fibers.

A number of wrap fiber groups N must be within the range of from 0.5 to 20 per 1 cm in length of the yarn in the mean value. If the number N is less than 0.5, the fasciate action to the core portion is too weak to have a compact structure thereof, whereby yarn breakage may occur during a post operation such as weaving or knitting. On the other hand, wrap fiber groups of more than 20 per 1 cm in length naturally cause the decrease of the core portion fibers as well as the mean degree of parallelism $\overline{\theta}$ exceeding 3°, both of which result in undesirable low mechanical properties of the yarn.

The staple fibers composing the fasciated yarn according to the present invention consist of wholly aromatic polyamide polymer fibers. The wholly aromatic polyamide polymers herein-described include not only in a narrow sense such as the aforesaid poly-para-phenylene-terephthalamide or poly-meta-phenyleneisophthalamide but also aromatic polyether amides having linkages defined below, in a wide sense.

That is, the term "aromatic polyether amide fiber" used herein means a fiber composed of polymers which consist of the recurring units of the following formulas (1) to (4):

$$-\underset{\underset{R_1}{|}}{N}-Ar_1-\underset{\underset{R_2}{|}}{N}-, \quad (1)$$

$$-\underset{\underset{O}{\|}}{C}-Ar_2-\underset{\underset{O}{\|}}{C}-, \quad (2)$$

$$-\underset{\underset{R_3}{|}}{N}-Ar_3-\underset{\underset{O}{\|}}{C}-, \text{ and} \quad (3)$$

$$-\underset{\underset{R_4}{|}}{N}-Ar_4-Y-Ar_3-\underset{\underset{R_5}{|}}{N}- \quad (4)$$

wherein $Ar_1$, $Ar_2$, and $Ar_3$, which may be the same as or different from each other, stand for the aromatic carbocyclic residues, the bonding chains of which all extend coaxially or parallel to the axis, or the aromatic heterocyclic residues, which are to be joined to adjacent atoms or grams by the ring atoms of the residues having the greatest distance, or combinations thereof, $Ar_4$ and $Ar_5$, which may be the same as or different from each other, stand for para- and meta-phenylene residues, $R_1$ to $R_5$, which may be the same as or different from each other, stand for hydrogen atoms or alkyl residues containing not more than 5 carbon atms, and Y is selected from a group consisting of $$-O-,\ -S-,\ -SO_2-,\ -CH_2-,$$

$$-\underset{\underset{CH_3}{|}}{\overset{\overset{CH_3}{|}}{C}}-,\ -\underset{\underset{O}{\|}}{C}- \text{ and } -\underset{\underset{R_6}{|}}{N}-,$$

wherein $R_6$ is the same as $R_1$ to $R_5$ having the meaning defined above, said recurring units (1) to (4) having substantially the molar equation of (1)+(4)=(2) and, when it is assumed that (1)+(2)+(3)+(4)=100 mol%, (3)=0 to 90 mol% and (4)=50 to 5 mol%, preferably 30 to 10 mol%.

As the aromatic carbocyclic residues with bonding chains extending coaxially, there may be mentioned, for example, 1,4-phenylene and 1,4-naphthylene residues. On the other hand, as the aromatic carboxylic residues with bonding chains extending parallel to the axis, there may be mentioned, for example, 1,5-napthylene and 2,6-naphthylene.

The aromatic residues may be joined to each other by the residues selected from a group consisting of —N=N—, —N=CH—, —CH=CH—, and —C≡C—. The so-joined aromatic residues include, for example,

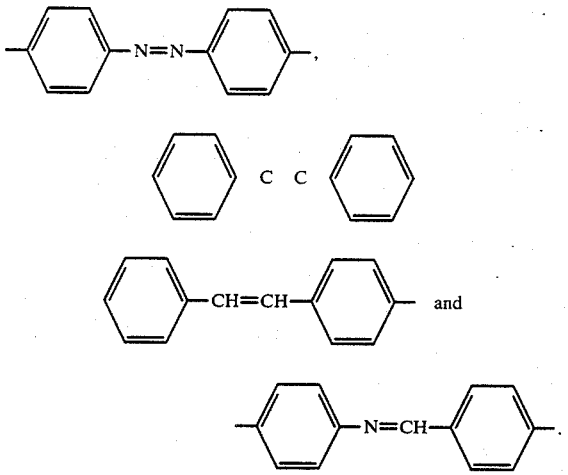

As the alkyl residues containing net more than 5 carbon atoms, there may be mentioned a methyl, an ethyl, a propyl, a butyl, a pentyl rest, and the like. Of these residues, methyl is preferable.

In the aromatic carbocyclic and heterocyclic residues, the hydrogen atoms bonded to the carbon atoms may be substituted. As such substituents, there may be mentioned halogen atoms (e.g., chlorine, bromine, and fluorine atoms), lower alkyl rests (e.g., methyl, ethyl, iso-propyl, and n-propyl rests), lower alkoxy rests (e.g., methoxy and ethoxy residues), a cyano rest, an acetyl rest, and a nitro residues. The chlorine atom and the methyl residues are preferable.

Fibers spinning from these polymers are well-known to have surprisingly excellent properties even in a high temperature atmosphere exceeding 300° C.

It is not possible, however, to attain the objects of the present invention by a spun yarn produced by means of the conventional spinning process in which the fibers are rearranged to a sliver form after being crimped and cut to staple fibers, because the abovesaid excellent properties of the fiber itself cannot be fully utilized in such spun yarn.

In this connection, a novel method for producing the yarn according to the present invention is explained hereunder.

A fiber bundle used for the present inventive method is prepared by the so-called "stretch-breaking" of a filament tow. The fiber bundle thus prepared has to be fasciated while keeping a parallel orientation thereof. Contrary to this, if using the conventional spinning process in which the staple fibers prepared by cutting the filament tow by a cutter are randomly mixed and then are rearranged to form a sliver, the orientation of the staple fiber in the resultant yarn cannot be completely parallelized and, in addition to this, the crimp of the staple fiber, which is necessary to enhance the spinnability thereof, causes an undesirable creep elongation of the yarn relative to a filament yarn. Thus, according to the present invention, it is one of characteristics of the method to prepare the fiber bundle by taking care not to disturb the parallel orientation of the fiber originally existing in the tow and not to deform the fiber by crimping.

The stretch-breaking is also effective for the micro-structure of the fiber. That is, since each filament is drawn to the utmost extent by the stretching force to break a filament, the degree of molecular orientation in the micro-structure of the fiber can be greatly improved, thereby the staple fiber thus obtained has superior mechanical properties to those of the original filament.

Figure 2:
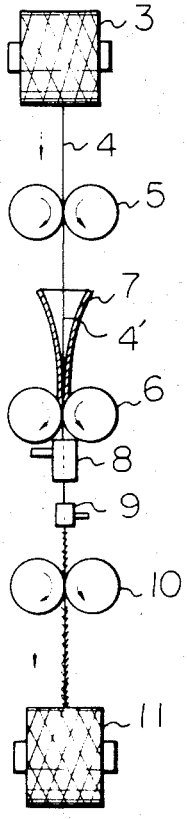
FIG. 2 is a diagrammatic elevational view of an embodiment of an apparatus for carrying out the method according to the present invention.

Prior to the stretch-breaking of the tow, it is necessary to impart a suitable amount of oil and/or water to the tow to be processed due to a rigidity of the aromatic polyamide fiber. The stretch-breaking is carried out between a pair of feed rollers 5 and a pair of stretch rollers 6 rotating at a higher rate than that of the former as shown in FIG. 2, which illustrates an embodiment of the apparatus utilized for practicing the method according to the invention. If the amount of the oil and/or water is too small, the tow may become charged with electricity which causes disturbance of the fiber parallelism or wrapping of the fibers around a metallic surface of the stretch rollers due to repulsion of the composing filaments. Contrary to this, if the amount of the oil and/or water is too large, slippage between the stretch rollers and the tow may occur, which makes it impossible to stretch-break the tow or, in an extreme condition, damages the apparatus due to frictional heat. A suitable amount should be within a range of from 0.05% to 0.30% for the oil and of less than 7% for the water relative to the weight of the tow. More specifically, for the water, the more preferable range is different to respective wholly aromatic polyamide fibers due to their intrinsic water absorptions; that is, less than 6% for poly-para-phenylene terephthalamide, and less than 3% for aromatic polyether amide.

The mean fiber length of the staple fiber stretch-broken from the tow depends on a distance between the feed rollers 5 and the stretch rollers 6 as well as a draw ratio therebetween.

The fiber bundle 4' thus stretch-broken is collectively guided to the stretch rollers 6 by a trumpet shaped chute 7 provided upstream of the former, and is thereby drafted to a predetermined thickness sliver. After being delivered from the stretch roller 6, the fiber bundle 4' is introduced into an aspirator 8 provided downstream of the stretch roller 6 along with a suction flow. Downstream of the aspirator 8 is arranged an air nozzle 9 within which the fiber bundle 4', introduced therein in a ribbon form, is false-twisted by a vortex, so that edge portion fibers thereof entangle around a core portion thereof to form a resultant fasciated yarn. The structure of the air nozzle 9 is disclosed, for example, in the above-mentioned U.S. Pat. No. 3,079,746.

In the above-described false-twist operation in the air nozzle 9, care must be taken not to have any slack in the tension of the fiber bundle 4'. In order to keep a suitable tension, a feed ratio of the stretch rollers 6 relative to draw-off rollers 10 provided downstream of the former has to be less than +4% preferably less than +1% including a 0% or minus feed ratio. In case the feed ratio exceeding +4%, the core portion 1 of the resultant yarn is partially twisted in an S or Z direction which causes the mean degree of parallelism to be more than 3° and the number of the wrap fiber groups to be more than 20 per 1 cm in length, both of which are not desirable as described before.

The resultant fasciated yarn is continuously wound on a cheese 11.

The yarn thus obtained has, as it is, excellent properties suitable for attaining the objects of the present invention. However, the properties can be improved more by heat treatment carried out after the yarn forming.

Figure 3:
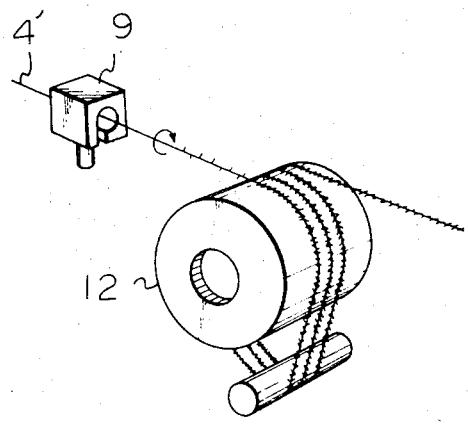
FIG. 3 shows an enlarged oblique view of another embodiment of the apparatus for carrying out a method according to the present invention.

This heat treatment may be exercised continuously subsequent to the false-twist operation, as illustrated in FIG. 3, by a heat roller 12, to a surface of which the yarn has made contact several times, or separately to the spinning process, may be carried out by an autoclave in which the cheese 11 of the yarn is steamed. The temperature of the heat treatment is preferably more than 200° C. and, thereby, the residual shrinkage and creep deformation of the yarn, especially in a high temperature atmosphere, can be improved to be suitable for usage under such conditions.

The present invention will be more apparent by the following examples showing the effects of the present invention.

EXAMPLE 1

A filament tow of 4400 d/3000 f consisting of poly-para-phenyleneterephthalamide fibers was processed by the apparatus shown in FIG. 2. The tow had an oil content and a water content of 0.25% and 4.0%, respectively, by weight, and a fiber composing the tow had no crimps at all.

The distance and the draw ratio between the feed rollers 2 and the stretch rollers 6 were adjusted to 750 mm and 25 times, respectively. The tow was stretch-broken to a staple fiber bundle having a mean fiber length $\bar{L}$ of 312 mm and, finally, was formed into a fasciated yarn of 30 S (cotton count) according to the present invention. Air pressures utilized for the aspirator 8 and the air nozzle 9 were 3 kg/cm$^2$ and 5 kg/cm$^2$, respectively.

EXAMPLE 2

A filament tow of 3000 d/2000 f consisting of aromatic polyetheramide fibers having no crimps, consisting of 25 mol% of para-phenylenediamine, 25 mol% of 3.4'-diaminodiphenylether, and 50 mol% of terephthalic acid was processed by the apparatus shown in FIG. 2. The tow had an oil and water content of 0.1% and 1.6%, respectively, by weight.

The distance and the draw ratio between the feed rollers 2 and the stretch rollers 6 were adjusted to 750 mm and 20 times, respectively. The tow was stretch-broken to a staple fiber bundle having a mean fiber length $\bar{L}$ of 290 mm and, finally, was formed into a fasciated yarn of 35 S (cotton count) according to the present invention. Air pressures utilized for the aspirator 8 and the air nozzle 9 were the same as Example 1.

EXAMPLE 3

A filament tow of 7000 d/3500 f consisting of poly-meta-phenyleneisophthalamide fibers having no crimps was processed as the same manner described in Examples 1 and 2. The distance and the draw ratio between the feed rollers 2 and the stretch rollers 6 were adjusted to 600 mm and 26 times, respectively. The tow was stretch-broken to a staple fiber bundle having a mean fiber length $\bar{L}$ of 230 mm and, finally, was formed into a fasciated yarn of 20 S (cotton count) according to the present invention. Air pressures utilized for the aspirator 8 and the air nozzle 9 were 4 kg/cm$^2$, respectively.

COMPARATIVE EXAMPLES 1 AND 2

The tow processings were carried out on the same tow utilized in Example 3 under the same conditions as Examples 1 and 2, except that the roller distances were adjusted to 280 mm and 1800 mm, respectively, thereby obtaining two comparative yarns having mean fiber lengths $\bar{L}$ of 103 mm and 710 mm, respectively.

COMPARATIVE EXAMPLE 3

The same filament tow as utilized in Example 3 was crimped, prior to the stretch-breaking operation, to have a crimpability CR of 10% by a stuffer box system without heating. The tow was processed under the same conditions as Example 3, thereby obtaining a comparative yarn of excess crimpability.

COMPARATIVE EXAMPLE 4

The same filament tow as utilized in Example 3 was processed under the same conditions as Example 3 except that the feed ratio between the two pairs of rollers 6 and 10 was adjusted to +7%, thereby obtaining a comparative yarn of the mean degree of parallelism $\theta$ of 4°.

COMPARATIVE EXAMPLES 5 AND 6

Tow processings were carried out with the same tow as utilized in Example 3 under the same conditions thereof, except that the feed ratios between the two pairs of rollers 6 and 10, and the air pressure of the aspirator 8 and the air nozzle 9 were adjusted to the following sets of values: (1) feed ratio −2%, air pressure 2 kg/cm$^2$ respectively, and (2) feed ratio +8%, air pressure 6 kg/cm$^2$ respectively, thereby obtaining two comparative yarns having the number of wrap fiber groups N of 0.42/cm and 23.0/cm, respectively.

Characteristics of the yarns thus obtained by Examples 1 through 3 and the Comparative Examples 1 through 6 are shown in Table 1, from which the excellence, in the mechanical properties, of the yarns according to the present invention is apparent compared to the yarns of the comparative examples.

TABLE 1

| | Structural Characteristics | | | | | Mechanical Properties[4] | | | | | |
|---|---|---|---|---|---|---|---|---|---|---|---|
| | Material | $\bar{L}$ (mm) | CR (%) | $\bar{\theta}$ (°) | N (per/cm) | Breaking Strength (g/d) | Elongation (%) | Strength at 3% Elongation (g/d) | Creep[5] Durability (%) | Heat[6] Shrinkage (%) | Note |
| Example 1 | PPTA[1] | 312 | 0 | 1.9 | 10.1 | 10.3 | 3.3 | 9.0 | 0.1 | 0.2 | |
| Example 2 | PEA[2] | 290 | 0 | 2.5 | 12.0 | 11.0 | 3.1 | 10.8 | 0.0 | 0.2 | |
| Example 3 | PMIA[3] | 230 | 0 | 1.4 | 8.7 | 5.5 | 13.0 | 2.5 | 0.5 | 3.4 | |
| Comparative Example[1] | " | 103 | 0 | 2.9 | 15.6 | 2.1 | 11.9 | 1.9 | 1.6 | 3.0 | very fluffy, uneven in |

TABLE 1-continued

| | Structural Characteristics | | | | | Mechanical Properties[4] | | | | | |
|---|---|---|---|---|---|---|---|---|---|---|---|
| | Material | $\bar{L}$ (mm) | CR (%) | $\bar{\theta}$ (°) | N (per/cm) | Breaking Strength (g/d) | Elongation (%) | Strength at 3% Elongation (g/d) | Creep[5] Durability (%) | Heat[6] Shrinkage (%) | Note |
| Comparative Example[2] | " | 710 | 0 | 0.8 | 1.4 | 5.6 | 13.5 | 2.6 | 0.3 | 3.8 | thickness, filament-like yarn uneven in thickness |
| Comparative Example[3] | " | 212 | 10 | 2.3 | 9.2 | 4.6 | 14.3 | 2.3 | 0.7 | 3.2 | |
| Comparative Example[4] | " | 230 | 0.5 | 4.0 | 13.5 | 4.1 | 16.4 | 2.0 | 2.0 | 3.1 | |
| Comparative Example[5] | " | 230 | 0 | 1.1 | 0.42 | 3.6 | 14.0 | 2.2 | 1.0 | 3.4 | loose structure |
| Cooperative Example[6] | " | 230 | 0.5 | 5.1 | 23.0 | 3.3 | 15.8 | 1.8 | 2.2 | 3.1 | excessive spiral form |

Note:
(1)poly-para-phenyleneterephthalamide
(2)aromatic polyether amide
(3)poly-meta-phenyleneisophthalamide
(4)The mechanical properties were measured on a twisted yarn of 300 t/m.
(5)The creep durability was measured by the method in which a test piece is loaded by a weight of 0.33 g/d in the atmosphere at a temperature of 250° C. for 2 hours and thereafter an elongation is calculated from the lengths of the test piece before and after loading.
(6)The heat shrinkage was calculated from the length of the test piece freely shrunk in a dry heat environment of 210° C.

EXAMPLE 4

A filament tow of 7000 d/6000 f consisting of poly-meta-phenyleneisophthalamide fibers having no crimps was processed by the apparatus shown in FIG. 2.

The distance and the draw ratio between the feed rollers 2 and the stretch rollers 6 were adjusted to 600 mm and 26 times, respectively. The tow was stretch-broken to a staple fiber bundle having a mean fiber length $\bar{L}$ of 230 mm and, finally, was formed into a fasciated yarn A of 20 S (cotton count) by adjusting the air pressures of the aspirator and the air nozzle to 4 kg/cm$^2$ and 5 kg/cm$^2$, respectively.

On the other hand, the same tow as described in Example 4, was cut to form staple fibers of 2 inch lengths after crimps were imparted by a stuffer box system, and the staple fibers were spun to become a spun yarn B as a comparative example by means of a conventional cotton spinning system.

Figure 6:
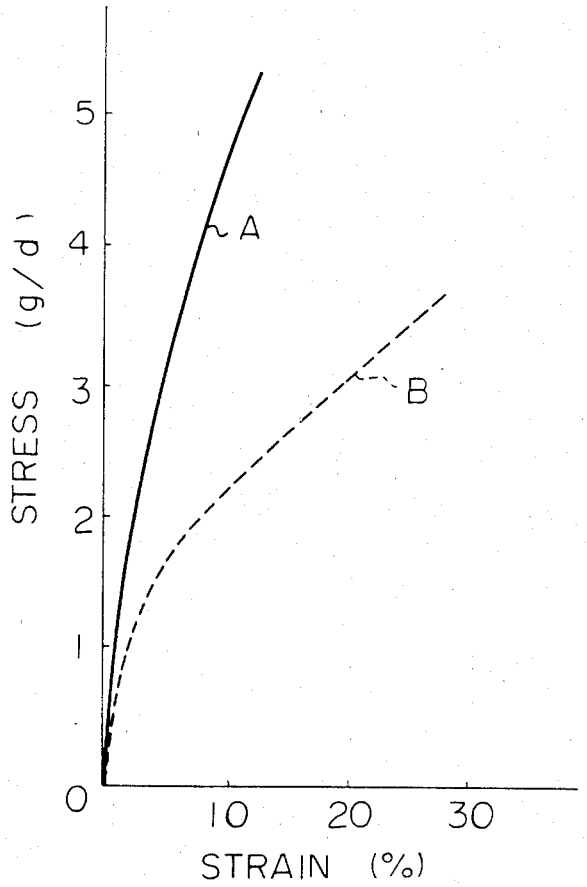
FIG. 6 is a graph of stress-strain curves of the present invented yarn and a conventional spun yarn of the same polymer fiber.

Measurement was carried out on the two yarns A and B regarding a tensile strength, results of which are shown on the graph in FIG. 6.

As is apparent from the graph, the yarn A according to the present invention shows a different stress-strain curve from that of the comparative yarn B.

Further, the creep durabilities of both the yarn A and B were 0.5% and 5.0%, respectively.

Next, how the present invented yarn is utilized in the industrial material field, is explained.

The yarn according to the present invention can be utilized for a bag filter, because of its excellent mechanical strength and creep durability in a high temperature condition. Further, the yarn is suitable for a reinforcing member embedded in a mold material such as rubber because the yarn is rich in fluffs and in inter-fiber porosity which enhance the anchoring effect in the mold material. The yarn also can be preferably utilized for sewing thread due to its heat radiation ability which serves to suppress the temperature elevation of a sewing needle even at a high sewing speed.

The above-mentioned effects will be more apparent by the following examples.

EXAMPLE 5

A fasciated yarn of 20 S (cotton count) having a mean fiber length of 230 mm was prepared from a filament tow of 7000 d/1000 f consisting of poly-meta-phenyleneisophthalamide fibers by utilizing the apparatus shown in FIG. 2.

A bag filter C according to the present invention was manufactured from a satin made of the abovesaid yarn. Densities of the warp and weft were 73 ends/in and 57 picks/in, respectively.

On the other hand, another bag filter D was manufactured from the same kind of fabric made of the yarn B as described in Example 4 as a comparative example.

The two bag filters C and D were tested on air permeability and dimensional stability, results of which are tabulated in Table 2.

TABLE 2

| | Air Permeability[1] (cc/cm$^2$/sec) | Dimensional[2] Stability (%) |
|---|---|---|
| C | 11 | 2 |
| D | 10 | 7 |

Note:
(1)The air permeability was measured according to JIS-L 1096-6-27-1-A.
(2)The dimensional stability was calculated from an elongation of the bag filter when being exposed in the atmosphere at a temperature of 200° C. under a load of 20 kg/10 cm in width for 7 days.

EXAMPLE 6

A fasciated yarn of 3.6 S (cotton count) was produced, according to the present invention, from a filament tow of 150,000 d consisting of the same aromatic polyether amide fiber as utilized in Example 2 by means of the apparatus shown in FIG. 2, thereby being knit in a tubular braid. The braid was layered in a hose structure as an inner reinforcement 52 along with an inner rubber layer 51, a polyester filament fabric 53, and an outer rubber layer 54.

On the other hand, a filament yarn of 1500 d/1000 f consisting of the same polymer fiber as above was knit to form the same tubular braid and, thereafter, was incorporated into a comparative hose structure instead of the abovesaid inner reinforcement 52.

Comparison of the two hoses in shown in Table 3.

TABLE 3

| Measured Item | Processing Condition | Example 6 | Comparative Example |
|---|---|---|---|
| Oil Durability | Untreated | 1803 | 1712 |

TABLE 3-continued

| Measured Item | Processing Condition | Example 6 | Comparative Example |
|---|---|---|---|
| | | (100) | (100) |
| (kg/cm²) | 150° C. × 100 hr | 1803 | 1712 |
| (%) | | (100) | (100) |
| | 150° C. × 200 hr | 1785 | 1678 |
| | | (99) | (98) |
| | 150° C. × 500 hr | 1767 | 1644 |
| | | (98) | (96) |
| Wearability | | 83.5 | 68.2 |
| Chemical Durability | Untreated | 100 | 100 |
| | $H_2SO_4$ | 99 | 96 |
| | NaOH | 97 | 94 |
| Steam Durability | Untreated | 100 | 100 |
| | 150° C. × 500 hr in steam | 93.6 | 87.3 |

The measurements of each item are as follows:

1. Oil Durability

Three hoses to be tested were filled with brake oil and were left in the atmosphere at a temperature of 150° C. for 100, 200, and 500 hours, respectively. Each burst test was carried out on one of the hoses at each time period.

2. Wearability

A hose to be tested was subjected to repeated bending motions caused by a pulley, on which the hose was mounted. The pulley had a diameter 15 times of the hose width and was rotated reciprocally at a rate of 10 m/sec. After 2000 revolutions under a tension of 5 kg/cm, the breaking strength of the hose was measured.

From this value and the strength of the untreated one, the strength retaining ratio was calculated.

3. Chemical Durability

Two hoses to be tested were immersed into a solution of 20% sulfuric acid at 90° C. and a solution of 10% caustic soda at 95° C., respectively, for 100 hours.

From the breaking strengths of the treated hoses and the untreated one, the strength retaining ratios to each chemical were calculated.

4. Steam Durability

Through a hose to be tested, super heated steam of 150° C. was introduced for 500 hours. From the breaking strengths of the treated hose and the untreated hose, the strength retaining ratios were calculated.

EXAMPLE 7

The same fasciated yarn of 3.6 S (cotton count) as obtained in Example 6 was two-plied with an S twist of 10 t/10 cm to form a cord according to the present invention. The cord was immersed into a first bath, which was followed by drying at 150° C. for 1 minute and baking at 240° C. for 1 minute. Then, the cord was immersed into a second bath which was followed by drying at 150° C. for 1 minute and baking at 240° C. for 1 minute, thereby obtaining a cohesive cord for a timing belt. Formulas of the first and second baths are as follows:

| First bath | |
|---|---|
| Denacol ® FX-611 (NAGASE SANGYO K.K.) (sorbitolpolyglycidile ether) | 6 parts |
| Neocol ® SW-30 (DAIICHI KOGYO SEIYAKU K.K.) (dioctylsulfosuccinate-natrium salt) | 4 parts |
| Hylene ® MP (Du Pont De Nemours & Co.) (phenol blocked 4,4'-diphenyle-methanediisocyanate) | 60 parts |
| Nipol ® 2518FS (Nippon Zeon K.K.) (vinylpyridine-styrene-butadiene polymer) | 125 parts |
| Water | 805 parts |
| Total | 1000 parts |
| **Second bath** | |
| Resorein | 15 parts |
| Formalin (37 weight %) | 17 parts |
| Caustic Soda Solution (10 weight %) | 6 parts |
| Nipol ® 251FS (40 weight %) | 400 parts |
| Water | 562 parts |
| Total | 1000 parts |

On the other hand, utilizing a filament yarn of 1500 d/1000 f consisting of the same aromatic polyether amide fibers as the above-said invented yarn, another cord was prepared, as a comparative example, according to the same process as described above.

Comparisons between the two cords and between the two timing belts for automobile engine utilizing the each cord are shown in Table 4.

TABLE 4

| Characteristics | | Example 7 | Comparative Example |
|---|---|---|---|
| CORD | | | |
| Breaking Strength | (kg) | 96 | 78 |
| Young's Modulus | (kg/d) | 650 | 590 |
| Pull-Out Force | (kg/cm) | 27 | 16 |
| Wet Heat Durability | (%) | 98 | 95 |
| BELT | | | |
| Wearability | 100 hr | 98 | 95 |
| (%) | 200 hr | 96 | 85 |

Measurements of each item are as follows:

1. Breaking Strength and Young's Modulus

These items were tested by means of a Tensiron stress-strain tester provided by TOYO-BALDWIN K.K.

2. Pull-Out Force

A two-plied cohesive cord to be tested was embedded in a rubber layer of 1 cm width composing a timing belt, so that the cord was directed perpendicular to the longitudinal direction of the belt. Then the belt was vulcanized under a temperature of 160° C. for 20 minutes. A force was measured, which is necessary to pull out the cord from the structure of the vulcanized belt, at a rate of 200 cm/min.

3. Wet Heat Durability

A cord to be tested was treated in an autoclave filled with steam of 150° C. (6 kg/cm²) for 100 hours. The strength retaining ratios were calculated from the breaking strengths of the treated cord and the untreated one.

4. Wearability

A cord to be tested was subjected to repeated elongations of 6% and compressions of 18%, caused by a Goodrich type disc tester, for 100 hours or 200 hours. The strength retaining ratios were calculated from the breaking strengths of the treated cord and the untreated one.

EXAMPLE 8

Figure 4:
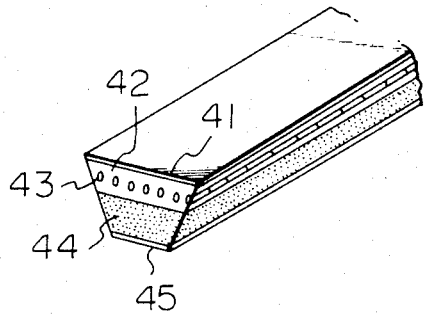
FIG. 4 is a partially sectional oblique view of a V-belt structure utilizing yarn according to the present invention.
Figure 5:
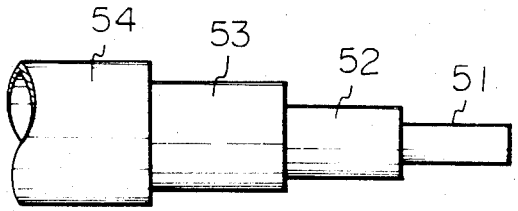
FIG. 5 is a partially broken side view of a hose structure utilizing a yarn according to the present invention.

The same fasciated yarn of 3.6 S (cotton count) as obtained in Example 6 was two-plied with a primary twist of 109 t/m and, then, the resultant yarn was three-plied with a final twist of 227 t/m to form a cord. The cord was incorporated into a V-belt as shown in FIG. 4, in which reference numerals 41 and 45 designate cotton fabrics, respectively; 42 and 44 chloroprene rubber layers, respectively; and 43 the cord consisting of the invented yarns.

On the other hand, utilizing a filament yarn of 1500 d/1000 f consisting of the same aromatic polyether amide fibers as the invented yarn, another cord was prepared according to the same process as described above and was incorporated into another V-belt as a comparative example.

Comparisons between the two V belts are shown in Table 5.

TABLE 5

| Measured Item | | Example 8 | Comparative Example |
|---|---|---|---|
| Breaking Strength | (kg) | 1435 | 1404 |
| Breaking Elongation | (%) | 1.0 | 1.5 |
| Young's Modulus | (g/d) | 540 | 480 |
| Wearability | (kg) | 1317 | 1264 |
| | (%) | 90 | 90 |
| Creep Durability | (%) | 0 | 0 |
| Wet Heat Dimensional Stability | (%) | 0 | 0 |
| Chemical Durability | Untreated | 100 | 100 |
| (Strength retaining | $H_2SO_4$ | 99 | 96 |
| ratio) (%) | NaOH | 97 | 94 |

Measurements of each item are as follows:

1. Breaking Strength, Breaking Elongation, and Young's Modulus

These items were tested by means of a Tensiron stress-strain tester provided by TOYO-BALDWIN K.K..

2. Wearability

The V-belt to be tested was subjected to repeated bendings caused by a pulley, on which the V-belt was mounted. The pulley had a diameter 15 times of the V-belt width and was rotated at a rate of 10 m/sec. After $10^9$ revolutions in the atmosphere having a temperature of 16° C. and an RH of 65% under a tension of 5 kg/cm, the breaking strength of the V-belt was measured and the strength retaining ratio was calculated relative to the untreated one.

3. Creep Durability

A creep tester provided by K. K. IWAMOTO SEISAKUSHO was utilized.

4. Wet Heat Dimensional Stability

The V-belt to be tested was subjected to repeated bendings under conditions of 40° C. temperature and 100% RH by the same device as utilized for testing the wearability. After $10^9$ revolutions under a tension of 1 kg/cm, the dimensions of the V-belt were measured and compared to the original ones.

5. Chemical Durability

Two V-belts to be tested were immersed into aqueous solutions of 20% sulfuric acid at 95° C., and 10% caustic soda at 95° C., respectively, for 100 hours.

From breaking strengths of the treated V-belts and that of the untreated one, the strength retaining ratios to each chemical were obtained.

EXAMPLE 9

The same fasciated yarn of 3.6 S (cotton count) as obtained in Example 6 was chopped to a plurality of pieces of 5 mm in length. The chopped pieces were mixed with a heat durable rubber composition described in Table 6 with a weight ratio of 2.0:100, and the mixed composition was extruded through a slit to form a mold A in a sheet form of 3 mm in thickness. The mold A was processed, according to the following steps, to have a test piece: preparing two sheets of the above-said rubber composition not containing the chopped pieces, having thicknesses of 5 mm and 2 mm, respectively; interposing a canvas woven from a polyester yarn between the prepared two sheets to form a layered sample of 30 mm in width; peeling the rubber sheet of 5 mm in thickness along a 100 mm length and complementing a separately prepared rubber sheet of 2 mm in thickness of the same composition and the mold A of 3 mm in thickness in a layered manner to have a sample; and vulcanizing the sample under a pressure of 50 kg/cm$^2$ to make a finished test piece.

The test piece was subjected to repeated bendings of 60 Hz by means of a hot pulley of 125° C. surface temperature and a 75 mm diameter under a tension of 55 kg, and the time required to cause a crack on a surface of the test piece was measured.

On the other hand, as a comparative example, a mold B was prepared by utilizing a filament yarn of 1500 d/1000 f consisting of the same aromatic polyether amide fibers as the yarn utilized in the mold A, and another test piece was obtained in accordance with the same manner as described above and subjected to the cracking test.

The results of the tests are tabulated in Table 7 showing data for two test pieces for each of the molds A and B, one of which was prepared along an orientation of the chopped pieces and the other perpendicular thereto. In this connection, the chopped pieces in the rubber composition are easily oriented along a flowing direction by being passed through a conduit in a fluid state before extrusion.

TABLE 6

| Component | Parts by weight |
|---|---|
| Copolymerized rubber of Ethylene-Hexafluoropropylene | 70 |
| Copolymerized Rubber of Ethylene-Propylene | 20 |
| Chlorinated Butylic Rubber | 10 |
| Carbon | 25 |
| Zinc Oxide | 5 |
| Stearic Acid | 0.5 |
| Antioxidant(1) | 3 |
| Peroxide(2) | 2.5 |
| Triallylisocyanurate | 1.5 |

Note:
(1)mercaptobenzimidazol
(2)PETROXIMON ® F-400 (NIPPON YUSHI K.K.)

TABLE 7

| Orientation Angle (°) | Test Piece | Time for Cracking (hr) |
|---|---|---|
| 0 | Example 9 | 87 |
| | Comparative Example | 74 |
| 90 | Example 9 | 61 |
| | Comparative Example | 43 |

EXAMPLE 10

A filament tow of 3000 denier consisting of the same aromatic polyether amide fibers as utilized in Example 2 was processed by the apparatus shown in FIG. 2 to form a fasciated yarn A of 53 S (cotton count) according to the present invention. The yarn A was two-plied with a primary twist of S 700 t/m and the resultant yarn was three-plied with a final twist of Z 450 t/m, thereby obtaining a sewing thread.

On the other hand, three comparative sewing threads B, C, and D consisting of a polyester filament yarn, a spun yarn of poly-meta-phenyleneisophthalate staple fibers of 50 mm length, and a filament yarn of the same aromatic polyether amide fibers as the yarn A, respectively, were prepared.

Sewing tests were carried out on the four sewing threads, and the results thereof are shown in Table 8.

It is apparent from Table 8 that the thread A according to the present invention shows a constant mechanical strength throughout the sewing operation, and further suggests a possibility to endure a higher sewing rate than the one consisting of the filament yarn.

TABLE 8

| Measuring Items | | | Test Piece: Example 10 A | Comparative Examples B | C | D |
|---|---|---|---|---|---|---|
| Twist (t/m) | | Primary | 450 | 540 | 450 | 450 |
| | | Final | 700 | 760 | 700 | 700 |
| Thickness (d) | | | 365 | 360 | 375 | 365 |
| Critical Sewing Speed (rpm) | | | more than 5,500 | 2,000 | 4,500 | 5,000 |
| Mechanical Strength | Before Sewing | Breaking Strength (g) | 4956 | 2340 | 1510 | 4891 |
| | | Breaking Elongation (%) | 8.7 | 23.0 | 27.0 | 10.5 |
| | | Breaking Stress (g/d) | 13.6 | 6.5 | 4.0 | 13.4 |
| | After Sewing | Breaking Strength (g) | 4956 | 1116 | 1474 | 4890 |
| | | Breaking Elongation (%) | 8.7 | 17.2 | 30.5 | 10.5 |
| | | Breaking Stress (g/d) | 13.6 | 3.1 | 3.6 | 13.4 |
| Strength Retaining | | | 100 | 47.5 | 90.0 | 100 |

TABLE 8-continued

| Measuring Items | Test Piece: Example 10 A | Comparative Examples B | C | D |
|---|---|---|---|---|
| Ratio (%) | | | | |

Conditions of the sewing tests are as follows:

(1) Regarding the mechanical strength;
type of sewing machine: DDC-227 provided by JUKI MISHIN K.K.;
sewing needle: DBX 1 #14;
sewing speed: 4,500 rpm; and
fabric to be sewn: four-plied serge fabrics, each woven from a spun yarn consisting of polyester fiber (65%) and rayon fiber (35%);

(2) Regarding the critical sewing speed;
type of sewing machine: the same type as above;
sewing needle: DBX 1 #18; and
fabric to be sewn: eight-ply fabrics of the same type as above.

We claim:

1. A fasciated yarn consisting of staple fibers of a wholly aromatic polyamide polymer prepared by the stretch-breaking of a tow, comprising a core portion and a plurality of wrap fiber groups wrapped around said core portion, said yarn being characterized in that said staple fiber has a mean fiber length within the range of from 150 mm to 600 mm, a crimpability of less than 5%, and a mean degree of parallelism ($\overline{\theta}$) of less than 3°, and that the number of said wrap fiber groups is within the range of from 0.5 to 20 per 1 cm in length of said yarn.

2. A fasciated yarn according to claim 1, in which said wholly aromatic polyamide polymer is selected from a group consisting of poly-para-phenyleneterephthalamide polymers, poly-meta-phenyleneisophthalamide polymers, and aromatic poly-etheramide polymers.

* * * * *